US006553884B1

(12) United States Patent
Lühmann et al.

(10) Patent No.: US 6,553,884 B1
(45) Date of Patent: Apr. 29, 2003

(54) ADHESIVE TAPE DISPENSER AND ITS USE

(75) Inventors: Bernd Lühmann, Norderstedt (DE); Ralf Schliephacke, Norderstedt (DE); Jörn Leiber, Heiligenstedtenerkamp (DE); Andreas Reklau, Freising (DE); Hans Hazes, Amsterdam (NL); Hansjürgen Linde, Coburg (DE); Uwe Neumann, Coburg (DE); Peter Kubasch, Lübeck (DE)

(73) Assignee: tesa AG, Hamburg (DE)

( * ) Notice: Subject to any disclaimer, the term of this patent is extended or adjusted under 35 U.S.C. 154(b) by 0 days.

(21) Appl. No.: 09/154,123

(22) Filed: Sep. 16, 1998

(30) Foreign Application Priority Data

Sep. 20, 1997 (DE) ..... 197 41 618

(51) Int. Cl.[7] ..... B26D 5/10

(52) U.S. Cl. ..... 83/649; 83/436.5; 83/444; 83/611; 156/574; 156/577; 225/11; 225/14; 225/15; 225/16

(58) Field of Search ..... 83/649, 701, 436.5; 206/411; 225/19, 25, 33, 11, 15, 39, 56, 63, 14–16; 156/576, 577, 510

(56) References Cited

U.S. PATENT DOCUMENTS 2,540,697 A * 2/1951 Staples ..... 225/19
2,992,582 A * 7/1961 Castelli
3,050,853 A * 9/1962 Domeny
3,470,781 A * 10/1969 Doment
3,508,692 A * 4/1970 Holtan ..... 225/7
3,635,473 A 1/1972 Sasaki et al.
3,813,274 A 5/1974 Rothenberger
4,196,647 A * 4/1980 Fish ..... 83/175
4,244,254 A * 1/1981 Fish ..... 83/589
4,608,894 A * 9/1986 Lee et al. ..... 83/322
5,146,828 A * 9/1992 Huang et al. ..... 83/570
5,146,830 A * 9/1992 Granger ..... 83/649
5,678,689 A * 10/1997 Clark et al. ..... 206/408

FOREIGN PATENT DOCUMENTS

| | | |
|---|---|---|
| DE | 1085440 | 7/1960 |
| DE | 2161337 | 7/1972 |
| DE | 89 04 789 | 8/1989 |
| GB | 765496 | 1/1957 |

* cited by examiner

*Primary Examiner*—Carl J. Arbes
*Assistant Examiner*—Minh Trinh
(74) *Attorney, Agent, or Firm*—Norris, McLaughlin & Marcus

(57) ABSTRACT

An adhesive tape dispenser for dispensing and cutting a length of an adhesive tape. The adhesive tape dispenser comprises an adhesive tape cutting device. The adhesive tape cutting device comprises a) a resting surface to which a tacky side of said adhesive tape can be adhered while the adhesive tape is being cut, b) two lateral webs extending in the same direction from both edges of the resting surface to serve as guides for the adhesive tape, and c) a cutting blade having a blade edge and positioned on an inner side of one or both lateral webs in such a way that the blade edge is inclined at an angle which is oblique relative to the resting surface. The lateral webs have a height from the resting surface which is the same or is higher than each cutting blade. The adhesive tape dispenser is useful to dispense and cut adhesive tapes comprising a backing of biaxially oriented or highly stretched film, such as polyolefin.

12 Claims, 3 Drawing Sheets

ADHESIVE TAPE DISPENSER AND ITS USE

The invention relates to an adhesive tape dispenser with a cutting-off device which has a blade, and to its use for cutting off adhesive tapes without injury.

PRIOR ART

Roller-type dispensers for rolls of adhesive tape serve the user as a receptacle for storing the rolls of tape themselves and as an application aid when putting them to use. The primary task of an adhesive tape dispenser is the simple, easy and neat cutting to length of strips of adhesive tape in the length required for the intended use. Typical embodiments of dispensers comprise as basic elements a supporting housing, a roll receiving means in the form of a core, a rest for the adhesive tape and a cutting off or tearing off device. A distinction can be drawn between the following basic embodiments:

Dispensers of a usually very compact form (also referred to below as compact dispensers), comprising an open or closed housing, which, in side view, may be, for example, of a round, trapezoidal, rectangular or polygonal shape. For use, the roll of adhesive tape is put onto a usually cylindrical core receiving means, which is integrated approximately centrally in the housing. To the side, the dispenser contains a slit-like outlet gap, from which the adhesive tape is drawn out for cutting to length. The cutting blade by means of which a piece of adhesive tape of the desired length can be cut off is usually located on one side of the outlet slit. The side of the outlet slit opposite the cutting blade is usually intended as a receiving surface for the tacky side of the adhesive tape and is formed in such a way that a piece of self-adhesive tape adhesively fixed thereon can be easily lifted off. An exemplary embodiment of a corresponding dispenser is described in WO 95/23108.

Dispensers in which the housing receiving the roll of adhesive tape and of an open or closed design is spatially separate from the elements comprising the adhesive tape rest and the cutting blade. Corresponding dispensers are in widespread use as hand held dispensers and as desk-top dispensers. With reduced compactness, they offer the advantage that adhesive tape can be removed quickly and simply and one-hand operation is often possible. An exemplary embodiment of a corresponding dispenser is described by U.S. Pat. No. 4,059,210.

Dispensers in which the adhesive tape required can be transferred directly to the substrate, for example via a guide roll which at the same time acts as a pressure-exerting roll and (also referred to below as transfer dispensers). For cutting to length, the pressure-exerting roll has ahead of it a cutting blade or a comparable device by means of which the adhesive tape can be cut off, for example by a slight rotational movement of the dispenser. An exemplary embodiment of a corresponding dispenser is described by WO 96/06790.

For cutting to length a section of adhesive tape of the desired length, a corresponding piece of adhesive tape is unrolled and is cut off with the cutting blade. The form and materials of suitable cutting blades vary. Blades with a serrated cutting edge (blade edge) are used most frequently. In the case of injection-moulded dispensers, the serrated edge may be produced in the injection moulding process itself (see, for example, tesa Film-Abroller [roll dispenser] 55975-87). It is also customary to integrate into the dispenser a metal cutting blade. Among the advantages offered by metal blades in comparison with plastic serrated edges are greater mechanical strength and greater sharpness, so they are more durable and more flexible in use with respect to the materials which can be cut (for example with respect to film thickness or film type). To avoid injuries being caused by accidentally touching the blade edge, for example with the fingers, numerous proposals have been made. For instance, FR 2710331 "Dérouler de ruban adhesif" [adhesive tape roll dispenser], U.S. Pat. No. 5,022,576 "Lever operated protective cover for a saw tooth-shaped cutter", U.S. Pat. No. 5,393,367 "Tape dispenser with a protected cutting device" and U.S. Pat. No. 5,456,790 "Tape dispenser with a blade protector" describe various forms of protective covers for the cutting blade which can be moved manually or by means of an automatic mechanism, to the greatest extent exclude the possibility of the user being injured by the blade and at the same time serve as a guard to prevent damage to the blade. Examples of adhesive tape dispensers in which the cutting blade is available only when the dispenser is in use are described in JP 080112171 "Tape cutter", WO 95/23108 "Dispenser for adhesive tape and the like" and U.S. Pat. No. 5,456,790 "Tape dispenser with a blade protector".

A disadvantage of dispensers with serrated cutting blades is that self-adhesive films which use backing materials of low tear propagation resistance and low ductility in particular cannot be detached again satisfactorily from many adherend surfaces. This applies in particular to adhesive films which use as a backing highly stretched biaxially oriented films based on it-PP homopolymers, but equally to highly stretched films based on other highly crystalline polyolefins as well as biaxially stretched PETP, to name just a few. When using a dispenser blade with a serrated cutting edge, when a strip of adhesive film is cut off there is an impression of the structure of the teeth on the cut edge of the adhesive tape cut to length. The serrated blade edge and any sharp burr or damage there may be on the blade very often cause extremely fine tears in the cut edges of the adhesive film strips obtained. As a consequence of the impression left of the structure of the teeth and the said extremely fine tears in the cut edges of the adhesive film strip, the attempt by the user of the adhesive tape to detach an adhesively fixed adhesive film strip once again from the adherend surface in one piece very often fails. Rather, adhesive films often tear, starting from the existing cut edges, when it is attempted to detach them again. For the complete removal of an individual adhesive film strip, it is not uncommon for a laborious procedure to be subsequently required to prise the strip off the adherend surface. Difficult to remove remains of an adhesive film, remains of adhesive substance on the adherend surfaced as well as damage to sensitive underlying surfaces consequently cannot be ruled out.

The use of sharp smooth-edged cutting blades makes it possible for the aforementioned self-adhesive films to be detached again satisfactorily, since in this case there is no damage to the cut edges in the form of tears and the smooth form of the blade means that the cut edge is straight. For many applications, a smooth cut edge of the adhesive film is also desired for aesthetic reasons or else is advantageous or necessary for technical reasons, the latter for instance if the adhesive strip is to be used on a document to be photocopied and it is required that there is no or only minimal shadowing on the copies. For instance, DE 29616409 describes an adhesive film roll dispenser which uses commercially available exchangeable razor blades, as a result of which copying defects and soiling of the cutting blade edge do not occur. The tesa-Tischabroller [desk-top dispenser] 6082 uses smooth blades which make possible an absolutely straight cut edge of the adhesive tape to be cut into portions. Adhesive film strips which use a biaxially oriented PP backing, for example tesa-Multi-Film or tesa-Practic-Film, cut to length with the tesa-Tischabroller 6082, can be satisfactorily detached again in virtually all cases. However, injuries to the fingers in particular cannot be ruled out when the aforementioned dispensers are used. U.S. Pat. No. 4,175,685 describes an adhesive tape dispenser which uses a cutting unit containing a razor blade. To protect against injuries, a flexible filament-like material is wound spirally around the blade. The edge of the razor blade is accessible between individual turns of the spiral. A transversely cutting smooth blade, integrated into a blade bar, is used in the tesa-Industrie-Tischabroller [industrial desk-top dispenser] 6080. The special arrangement and orientation of the cutting blade beneath the blade bar to the greatest extent excludes the risk of the user being injured. The blade edge, running obliquely with respect to the plane of the adhesive tape to be cut, at the same time makes it possible for the adhesive tape to be easily cut to length. The tesa-Automat 6056 likewise uses a blade which runs obliquely with respect to the adhesive tape, this blade being electromagnetically activated. The risk of the user being injured by the cutting blade is likewise excluded to the greatest extent.

A disadvantage of the aforementioned adhesive tape dispensers with smooth, straight blade edges of great sharpness is the increased risk of injury at the cutting edges if there is no protective covering and additional manipulations are necessary when putting the adhesive film to use, due to the manual removal or displacing of a protective blade cover. In the case of the aforementioned cutting blades which are exposed by an automatic mechanism when they are put to use, an complex mechanical construction of the adhesive tape dispenser is necessary, which may increase manufacturing costs and the size of the units and may likewise reduce functionality.

It was the object of the invention to provide a remedy here, in particular to provide adhesive tape dispensers with cutting-off devices

- which allow the use of cutting blades which are easily accessible with the adhesive tape to be cut off,
- in which the use of extremely sharp cutting blades is possible, without there being a significant risk of the user being injured and without complex additional measures for protecting the user having to be integrated, such as for example blade covers or complex mechanical constructions which activate the blade only at the time it is to be used,
- which produce a smooth cut edge in the adhesive film, so that it is possible for applied adhesive films to be satisfactorily detached again (in particular adhesive films with a backing film based on biaxially oriented polypropylene),
- which allow extremely easily cutting off of adhesive films, in particular with biaxially stretched film backings,
- in which the cutting blades are protected to the greatest extent against mechanical damage,
- which can be produced at low cost.

This object is achieved by an adhesive tape dispenser which includes a cutting-off device as characterized in more detail in the claims.

BRIEF DESCRIPTION OF THE DRAWINGS

Embodiments of the invention will now be described in greater detail with reference to the drawings, wherein.

DETAILED DESCRIPTION

Figure 1:
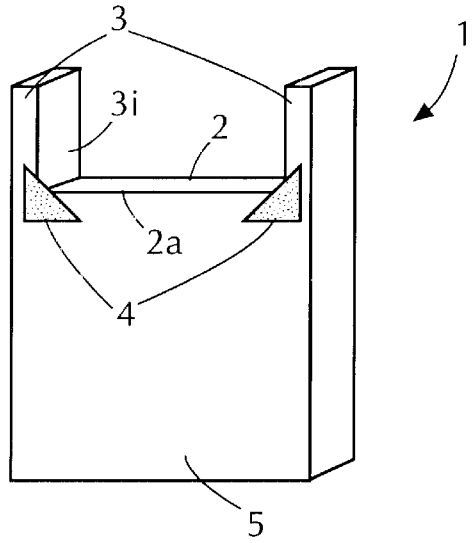
FIG. 1 shows an embodiment of a cutting device according to the invention having two cutting blades positioned on both sides of a resting surface.
Figure 2:
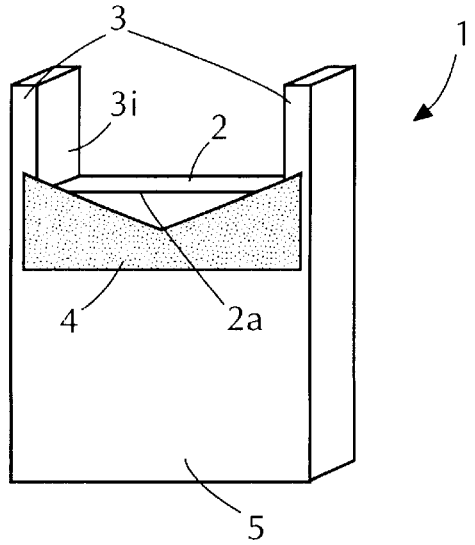
FIG. 2 shows a second embodiment of a cutting device according to the invention; having a single cutting blade spanning both sides of a resting surface.

FIG. 1 shows a cutting-off device (1) according to the invention, comprising a film resting surface (2), on the front side of which (side on which a cut-to-length piece of adhesive tape is removed) there is a cutting blade (4) integrated on both sides. The blade surfaces run approximately parallel to the front side of the cutting-off device; the blade edges are aligned obliquely at an angle between about 85° and 2°, preferably 70° and 5°, particularly preferably between 50° and 5°, with respect to the film resting surface (2). These angles apply, in the same way as other general particulars, independently of the embodiment according to FIG. 1. To the sides of the film resting surface (2) there are webs (3), which together with the base (5) of the cutting-off device can receive cutting blades. The height of the webs advantageously corresponds at least to the height of the cutting blades on the inner side (**3*i*) of the webs. The front edge (2*a*) of the film resting surface is advantageously formed in such a way that it extends the cuts which are made in the piece of adhesive tape to be cut to length when the cutting blades (4) cut into it in such a directed manner that a single smooth and virtually straight cut edge is produced, i.e. the cutting edges of the blades and the front edge lie in a line. For adhesive films based on biaxially stretched polypropylene backings, a straight front edge (2*a*) of the film resting surface with radii of curvature of < about 1 mm has proved to be preferred. The blade (4) may be in the form of two separate units, or else be formed by one part as shown in FIG. 2**. As an alternative to the position on the front side of the cutting-off device, the cutting blades may also be integrated in the same. It is advantageous here for producing a smooth cut edge that the joining line between the two blade edges is in the form of an edge which extends the cuts in the film.

To ensure adequate fixing of the adhesive film during the cutting off process, the film resting surface is preferably designed in such a way that the adhesive film rests with its full surface area on the tacky side of the same during cutting off.

The cutting-off devices represented in FIG. 1 and FIG. 2 allow outstanding cutting of self-adhesive films with, for example, a biaxially oriented polypropylene backing, with a biaxially stretched polyethyleneterephthalate backing, with a cellulose acetate backing or with a cellulose film backing, to name just a few. A smooth cut edge is in this case usually produced both if the self-adhesive film is drawn centrally downwards in front of the front edge of the cutting-off device, that is to say without deviation to the left or right, or else is drawn with a lateral deviation, that is to say obliquely to the left or to the right. What is important for simple cutting to length is that the self-adhesive film is cut into at one of the integrated cutting blades (4). This cut is subsequently extended at the from edge **(2*a*)** of the film resting surface in such a way that a smooth cut edge is produced over the entire width of the self-adhesive film used.

Figure 3:
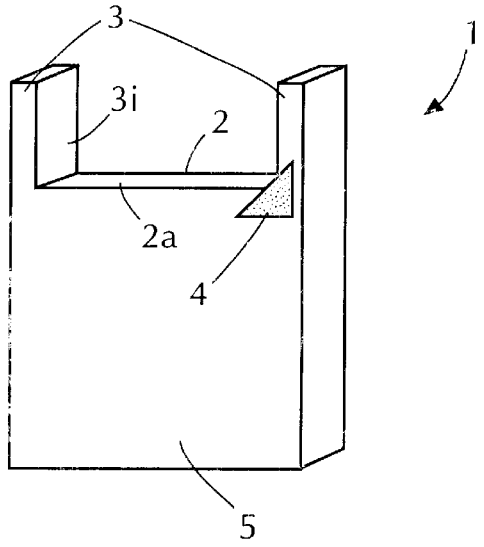
FIG. 3 shows a third embodiment of a cutting device according to the invention having a single cutting blade positioned on one side of a resting surface.

As shown in FIG. 3, according to the invention a cutting-off device with a cutting blade (4) only on one side can likewise be used. In this case, the cutting into the adhesive tape strip to be cut off takes place at this blade. The cut is correspondingly extended at the front edge **(2*a*) of the film resting surface (2)**, so that a smooth cut edge is produced over the entire width of the self-adhesive film used.

The cutting blades which can be used according to the invention may be of different forms. Examples include triangular blade geometries with a straight blade edge. Other forms comprise round blade edges or else blade edges which are made up of a plurality of straight and/or round segments. To be able to cut off adhesive films of different widths while at the same time using rigidly fixed blades in all cases, the distance apart of the cutting edges protruding above the film resting surface (2) is to be less than the width of the adhesive film used.

In the case of triangular blade geometries with a straight blade edge, the risk of injury increases with increasing height of the blades on the inner sides of the lateral webs and with the width of the cutting blades above the film resting surface. If the angle of inclination of the cutting blade (4) in FIG. 1 is 45°, and the height of the blades on the inner sides of the lateral webs **(3*i*) is < about 3 mm, which in this case is equal to the width of the blades above the film resting surface (2), injury to a finger can be effectively ruled out even if the finger is pressed hard into the edge in which the blade is located. A reduction of the angle of inclination of the blade edges reduces the risk of injury with the blade width above the film resting surface (3) unchanged, and thus makes it possible to use without injury blades which have a greater width above the film resting surface (2). Corresponding blades can be preferably used if it is intended to use adhesive films of different widths on a dispenser. Thus, at an angle of inclination of the cutting edge of 30°, a risk of injury is unlikely up to a lateral blade height on the inner sides of the webs (3*i*) of FIG. 1 of 2.5 mm. The blade width above the film resting surface (2) in FIG. 1 is in this case respectively 5 mm. With an angle of inclination of 15°, the possibility of injuries can be excluded to the greatest extent from a lateral blade height on the inner sides of the lateral webs (3*i*) of < about 2.0 mm. In this case, the respective blade widths above the film resting surface (2) in FIG. 1** are about 7.5 mm.

With blade edges formed concavely with respect to the film resting surface (2), a risk of injury is distinctly reduced even with large blade widths. Corresponding blades can therefore be preferably used if the adhesive films to be used vary very much in their width. What is more, the blades can run above the film resting surface over the entire width of the latter.

Figure 4A:
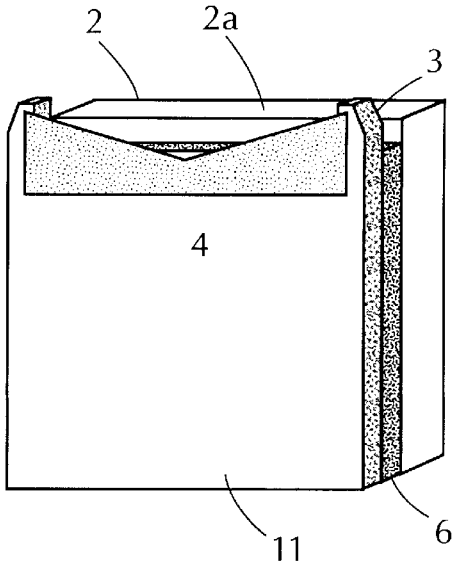
FIG. 4 depicts a fourth embodiment of a cutting device according to the invention wherein the cutting blades are separated from the resting surface by a spacer.
Figure 4B:
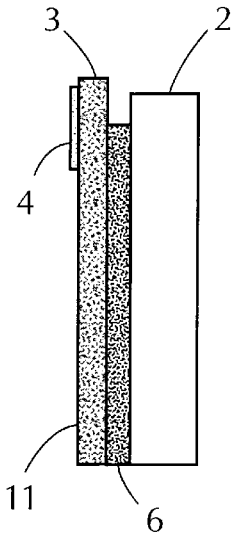
Figure 5:
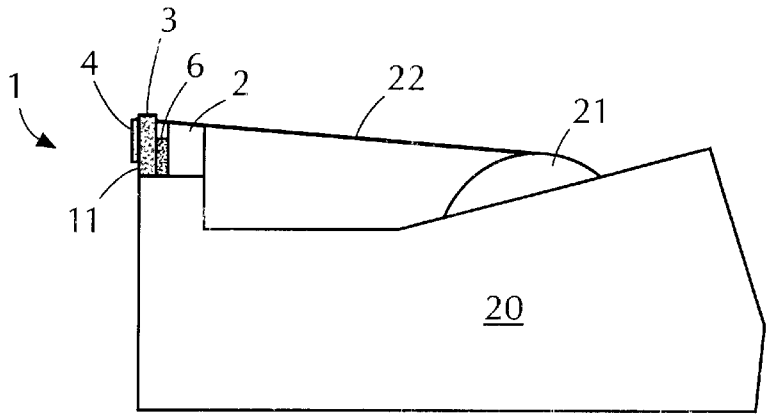
FIG. 5 shows a tape dispenser containing the cutting device depicted in FIG. 4.
Figure 6:
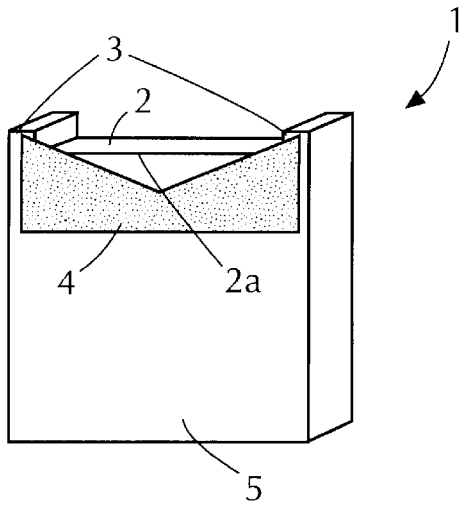
FIG. 6 shows a fifth embodiment of a cutting device according to the invention, wherein the height of two lateral webs is depicted as being the same as the height of the cutting blades.

In a further advantageous configuration, the film resting surface (2) may be separated from the plate (11) bearing the cutting blades by means of a spacer (6), for example, as shown in FIG. 4. The cutting blades (4) in FIG. 4 may be fixed on the front side of the plate (11) bearing the cutting blades, but may optionally also be embedded in the said plate or else be fastened on its rear. FIG. 5 diagrammatically shows an adhesive tape dispenser (20) containing in it a roll of adhesive film (21) or an adhesive tape (22) from which a piece of adhesive film has been cut to length and rests on the cutting-off device (1) as shown in FIG. 4.

In a specific configuration, it is possible for the distance apart of the cutting blades over the width of the cutting-off device can be set in position in such a way that an adaptation to adhesive films of different widths can be performed. For example, one or both of the lateral webs (3), provided with cutting blades (4), in FIG. 1 may be arranged movably parallel to the film resting surface. For simple and precise width positioning, there may advantageously be stops integrated into the cutting-off device, for example for the currently available adhesive film widths of 12 mm, 15 mm and 19 mm.

Cutting off devices for self-adhesive films according to the invention can be used in a large number of types of dispenser. Suitable types of dispenser include desk-top and hand held dispensers, in which the housing receiving the roll of adhesive tape is spatially separate from the film rest and cutting-off device, compact dispensers and likewise transfer dispensers, as described above.

A great number of commercially available cutting blades are suitable. Typical examples include blades of steel with preferred thicknesses of between about 0.08 mm and 0.8 mm. Steels may have been subjected to special hardening, for example for a titaniumnitride coating, in order to obtain increased blade edge lives. A typical grinding angle is 10°, it being possible for suitable blades to be ground on one or both sides. It is understood that the aforementioned configurations are given by way of example.

Test Methods

Testing for Satisfactory Redetachment of Applied Self-adhesive Films 10 strips of adhesive film, each about 3 cm in length, are cut off from the roll dispenser. Cutting off takes place by drawing the adhesive film strip at an angle of about 75° with respect to the front side of the cutting-off device without lateral deviation of the adhesive film strips (cutting off to the front). The test may likewise be performed with lateral deviation of the film (oblique cutting off). In the latter case, cutting off of the adhesive film in each case begins from one side. The adhesive film strips obtained are subsequently adhesively fixed on plastic panels consisting of rigid PVC (Type: Kömadur WA; Supplier: Messrs Krüger/Wedel) by lightly rubbing with a finger to exclude air bubbles, then are rolled over 5 times with a pressure-exerting roll weighing 1 kg. The PVC panels provided with the films of adhesive strip are subsequently kept for 3 days in a conditioning chamber (T=23±2+ C.; atmospheric humidity=50±10%).

For testing for satisfactory redetachment, the adhesive strips are detached manually from the PVC adherend surfaced. For this purpose, the adhesive film strips are detached with a finger nail, beginning from one corner, then are carefully peeled off to half the length of the adhesive film strip. At the opposite cut-off edge, the adhesive film strips are detached in the same way. All together, 20 detachment tests are performed in this way on the 10 adhesive film strips. The tests in which the adhesive film strips can be detached from the PVC without tearing at the cut-off edge are counted.

Testing for Risk of Injury

A tesa-Tischabroller [desk-top roll dispenser] 6059 which has been provided with the cutting-off device to be tested is standing on a table longitudinally in front of the person performing the test. The person performing the test has put onto his or her hand a Glovex Vinyl glove (Article No.:

71259). The test person places the index finger on the resting surface and presses the finger against the laterally arranged blade with a force of about 5N. Subsequently, the finger of the glove is examined for cuts. The test is carried out by persons whose fingers are about 12±2 mm in diameter.

Testing for Capability to Cut Off Pieces of Adhesive Film 10 strips of adhesive film, each of about 3 cm in length, are cut off from the roll dispenser. The cutting off takes place as described under "testing for satisfactory redetachment of applied self-adhesive films". The adhesive film strips are cut off without lateral deviation (cutting off to the front). The force required for cutting off the adhesive film strips is subjectively compared with that which is necessary for cutting off from the tesa-Tischabroller 6059. The assessment is as follows:

"moderately difficult" if the cutting off force is subjectively comparable with that force which is necessary for cutting off a piece of tesa-Multi-Film from the tesa-Tischabroller 6059, "very easy" if the cutting off force is subjectively comparable with that force which is required for cutting off a piece of tesa-Multi-Film from a tesa-Tischbroller 6059 on which the serrated cutting blade had been replaced by a razor blade (blade thickness=0.3 mm; material: steel; cutting edge ground vertically on both sides; grinding angle=2*10°).

EXAMPLE 1

On the housing of a tesa-Tischabroller 6059, the existing adhesively mounted cutting-off device with adhesive film rest is replaced by a cutting-off device consisting of aluminium, the upper part of which is shaped as shown in FIG. 1. A film resting surface of the dimensions 20 mm*3 mm (width*depth), running parallel to the standing surface of the adhesive tape dispenser, is adjoined on both sides by webs of the dimensions 5 mm*2.5 mm*3 mm (height*width*depth). Adhesively mounted on the front side of the adhesive film rest, on both corner regions, are right-angled triangular razor blades (thickness: 0.3 mm; steel ground vertically on both sides; grinding angle=2*10°) of the dimensions 5 mm*5 mm (lateral height*lower width) in such a way that the lower edge of the cutting blades runs parallel to the standing surface of the adhesive tape dispenser and a triangular piece of the cutting blades of a height of 2 mm and a width of 2 mm in each case protrudes above the film resting surface. The front edge of the film resting surface is of a right-angled form.

Self-adhesive films #1 to #6 of 19 mm in width are comparatively assessed for cutting off capability, structure of the cut edge and redetachment without tearing of adhesively fixed film strips. Furthermore, the risk of injury on the cutting blades is assessed. The following properties are obtained:

| Test/ adhesive film # | Backing | Backing thickness | Adhesive substance | Application of adhesive substance |
|---|---|---|---|---|
| 1.1/#1 | BOPP* | 28 μm | Acrylate copolymer | 19 g/m² |
| 1.2/#2 | BOPP*,** | 35 μm | Acrylate copolymer | 23 g/m² |
| 1.3/#3 | BOPP* | 40 μm | Acrylate copolymer | 23 g/m² |
| 1.4/#4 | CAC* | 50 μm | Acrylate copolymer | 25 g/m² |
| 1.5/#5 | BOPP* | 35 μm | Natural rubber/resin | 22 g/m² |
| 1.6/#6 | PE/EVAc*** | 80 μm | Acrylate copolymer | 25 g/m² |

-continued

| Test/ adhesive film # | Cutting off capability from the front/side | Cut edge | Redetachment without tearing | Risk of injury |
|---|---|---|---|---|
| 1.1/#1 | very easy/very easy | smooth, straight | >90% | no cuts |
| 1.2/#2 | very easy/very easy | smooth, straight | >90% | " |
| 1.3/#3 | very easy/very easy | smooth, straight | >90% | " |
| 1.4/#4 | very easy/very easy | smooth, straight | not tested | " |
| 1.5/#5 | very easy/very easy | smooth, straight | >90% | " |
| 1.6/#6 | easy/easy | smooth, straight | 100% | " |

*BOPP = biaxially oriented polypropylene; CAC = Cellulose acetate
corresponds to tesa-Multi-Film; *PE/EVAc Film PO 01612/6807.0010 of Messrs Renolit In all cases, a smooth and straight cut edge is obtained when using the cutting-off device according to the invention. All the adhesive films can be cut off very easily, both when cutting off to the front and when cutting off obliquely; the calendered film based on a mixture of PE and EVAc copolymer can be cut off easily. Virtually all the adhesive strips can be detached once again without tearing after adhesive fixing.

For comparison, adhesive films #1 to #3 are used on the tesa-roll dispenser 6059 fitted with an original blade. Cutting off is assessed in all cases as easy when cutting off obliquely and is moderately difficult when cutting off centrally. Redetachment of adhesively fixed adhesive film strips without tearing is possible only in about 10 to 30% of all cases.

EXAMPLE 2

A tesa-Tischabroller 6059 modified in an analogous way to Example 1 is provided with cutting blades of different forms. In the table below, the form of the blade respectively tested is sketched under "blade form". Under "blade dimensions", a indicates the blade height of the cutting blade at the inner edge of the lateral webs (3*i*) in FIG. 1 and b indicates the width of the cutting blades at the front edge of the film resting surface (2*a*) in FIG. 1. In all cases, a symmetrical test setup was chosen. tesa-Multi-Film (=adhesive film #2 from Example 1) in widths of 12 mm, 15 mm and 19 mm is comparatively tested for cutting ability, structure of the cut edge and redetachment without tearing of adhesively fixed adhesive film strips. Furthermore, the risk of injury on the cutting blades is assessed. For test 2.6, an original blade of the tesa-Tischabroller 6059 was cut to the specified form. For the other tests, blades corresponding to Example 1 were chosen as the starting material. The following properties are obtained:

| Test | Film width can be cut? 12/15/19 mm | Blade form | Blade dimensions a | Blade dimensions b | Risk of injury |
|---|---|---|---|---|---|

-continued

| | | | | | |
|---|---|---|---|---|---|
| 2.1 | no/yes/yes | | 2.6 mm | 2.6 mm | low |
| 2.2 | no/yes/yes | | 3.5 mm | 3.5 mm | yes |
| 2.3 | no/no/yes | | 1.5 mm | 1.5 mm | no |
| 2.4 | yes/yes/yes | | 1.0 mm | 6.0 mm | no |
| 2.5 | yes/yes/yes | | 2.0 mm | 6.0 mm | low |
| 2.6 | yes/yes/yes | | 2.0 mm | 6.0 mm | no |
| 2.7 | yes/yes/yes | | 2.0 mm | 6.0 mm | no |
| 2.8 | no/yes/yes | | 2.7 mm | 2.7 mm | no |

| Test | Cutting off capability to the front/obliquely 19 mm Film width | Cut edge | redetachment without tearing |
|---|---|---|---|
| 2.1 | very easy/very easy | smooth, straight | >90% |
| 2.2 | very easy/very easy | smooth, straight | >90% |
| 2.3 | very easy/very easy | smooth, straight | >90% |
| 2.4 | very easy/very easy | smooth, straight | >90% |
| 2.5 | very easy/very easy | smooth, straight | >90% |
| 2.6 | very easy/very easy | smooth, straight | >90% |
| 2.7 | very easy/very easy | smooth, straight | >90% |
| 2.8 | moderately difficult/ moderately difficult | smooth, straight | about 40% |

Depending on the blade geometry and blade size, test setups which reliably allow cutting of all or only some of the adhesive film widths can be accomplished. Triangular blade geometries, even with low angles of inclination, make it possible for all the tested adhesive film widths to be cut off very easily and smoothly, with at the same time only a low or no risk of injury if the blades come into direct contact with a finger. Cutting blades which are formed concavely with respect to the film resting surface prove to be particularly advantageous. The detachment of self-adhesive films without tearing is distinctly improved in all cases by the use of non-serrated, smooth, very sharp cutting blades in comparison with a classical dispenser blade.

EXAMPLE 3

On a tesa-Tischabroller 6059, the existing cutting-off device is replaced by a cutting-off device consisting of aluminium, the upper part of which is shaped as shown in FIG. 4. The adhesive film resting surface (2), running parallel to the standing surface of the adhesive tape dispenser and of the dimensions 24 mm*3 mm (width*depth), is provided on its front side with spacers (6) of different depths of from 2 mm to 5 mm. The plate (11) bearing the cutting blades and of the dimensions 38 mm*24 mm*0.5 mm (height width*depth), with lateral webs (3) 2 mm wide and 3 mm high, is fastened vertically adjustably on the spacers. Adhesively mounted on the front side of the plate (11) bearing the cutting blades there are in both corner regions right-angled triangular razor blades (thickness: 0.3 mm; steel ground vertically on both sides; grinding angle= 2×10°) of the dimensions 5 mm*5 mm (lateral height*lower width) in such a way that the blade edges form an angle of 45° with respect to the film resting surface and a piece of the cutting blades of a height a and a width b in each case protrude above the plate (11) bearing the cutting blades. The front edge of the plate bearing the cutting blades is of a right-angled form. The blade projection is defined as the difference between the height of the cutting blade upper edge on the inner sides of the plate (11) bearing the cutting blades and the height of the film resting surface (2).

tesa-Multi-Film (=adhesive film #2 from Example 1) of a width of 19 mm is comparatively tested for cuttability, and structure of the cut edge and redetachment without tearing of adhesively fixed adhesive film strips.

| Test | Blade form | Blade dimensions height a | Blade dimensions width b | Blade projection | Thickness of spacers | Cut edge |
|---|---|---|---|---|---|---|
| 3.1 | | 3 mm | 3 mm | 3 mm | 2 mm | smooth, straight |
| 3.2 | "—" | 3 mm | 3 mm | 1 mm | 2 mm | smooth, straight |
| 3.3 | "—" | 3 mm | 3 mm | 1 mm | 5 mm | smooth, straight |
| 3.4 | | 2 mm | 2 mm | 3 mm | 2 mm | smooth, straight |
| 3.5 | | 2 mm | 2 mm | 3 mm | 5 mm | smooth, straight |

| Test | Cutting off cabability to the front/to the side 19 mm film width | Detachment without tearing |
|---|---|---|
| 3.1 | very easy/very easy | >90% |
| 3.2 | very easy/very easy | >90% |
| 3.3 | very easy/very easy | >90% |
| 3.4 | very easy/very easy | >90% |

For all the test setups, very easy cuttability of the adhesive film used is observed, with the formation of a smooth cut edge. With decreasing blade projection, a minimum risk of injury is accomplished as a result of the small distance of the cutting blades from the film resting surface.

What is claimed is:

1. An adhesive tape dispenser for dispensing and cutting a length of an adhesive tape, said adhesive tape dispenser comprising an adhesive tape cutting device, said cutting device comprising a) a resting surface to which a tacky side of said adhesive tape can be adhered while said adhesive tape is being cut, b) two lateral webs extending in the same direction from both edges of said resting surface to serve as guides for said adhesive tape, and c) a cutting blade having a blade edge and positioned on an inner side of one or both lateral webs in such a way that the blade edge is inclined at an angle which is oblique relative to the resting surface, wherein the lateral webs each have a height from the resting surface which is the same or is higher than each said cutting blade.

2. The adhesive tape dispenser according to claim 1, wherein each cutting blade is arranged on one side of the cutting device.

3. The adhesive tape dispenser according to claim 1, wherein each cutting blade has a surface which is arranged parallel to one side of the cutting device.

4. The adhesive tape dispenser according to claim 1, wherein a cutting blade is positioned on both lateral webs.

5. The adhesive tape dispenser according to claim 1, wherein each cutting blade is positioned on an inner side of one or both lateral webs in such a way that the blade edge is inclined at an angle which is from 85° to 2° relative to the resting surface.

6. The adhesive tape dispenser according to claim 5, wherein each cutting blade is positioned on an inner side of one or both lateral webs in such a way that the blade edge is inclined at an angle which is from 70° to 5° relative to the resting surface.

7. The adhesive tape dispenser according to claim 6, wherein each cutting blade is positioned on an inner side of one or both lateral webs in such a way that the blade edge is inclined at an angle which is from 50° to 5° relative to the resting surface.

8. The adhesive tape dispenser according to claim 1, wherein the resting surface comprises a resting surface edge, and said resting surface edge is positioned relative to the blade edge of each cutting blade such that the resting surface edge and each blade edge cooperate to produce a smooth cut edge in said adhesive tape.

9. The adhesive tape dispenser according to claim 8, wherein the resting surface edge is a straight edge, and said straight edge is aligned with the blade edge of each cutting blade in a straight line.

10. The adhesive tape dispenser according to claim 1, which comprises multiple cutting blades each having a single blade edge, or comprises a single cutting blade having two opposing blade edges.

11. The adhesive tape dispenser according to claim 1, wherein each cutting blade has a triangular shape.

12. The adhesive tape dispenser according to claim 1, wherein at least one cutting blade is positioned on said lateral web in such a way that said at least one cutting blade can be adjusted to permit the cutting of adhesive tapes of different widths.

* * * * *